US005214925A

United States Patent [19]

Hoy et al.

[11] Patent Number: 5,214,925

[45] Date of Patent: Jun. 1, 1993

[54] USE OF LIQUIFIED COMPRESSED GASES AS A REFRIGERANT TO SUPPRESS CAVITATION AND COMPRESSIBILITY WHEN PUMPING LIQUIFIED COMPRESSED GASES

[75] Inventors: Kenneth L. Hoy, St. Albans; Kenneth A. Nielsen, Charleston, both of W. Va.

[73] Assignee: Union Carbide Chemicals & Plastics Technology Corporation, Danbury, Conn.

[21] Appl. No.: 767,829

[22] Filed: Sep. 30, 1991

[51] Int. Cl.[5] ..... F17C 7/02

[52] U.S. Cl. ..... 62/50.6; 62/50.1; 62/386; 417/901

[58] Field of Search ..... 62/48.3, 50.6, 52.1, 62/50.2, 50.7, 54.1, 505, 50.1, 386; 417/901

[56] References Cited

U.S. PATENT DOCUMENTS

| | | | |
|---|---|---|---|
| 2,033,094 | 3/1936 | De Motte | 62/50.1 |
| 2,594,512 | 4/1952 | Steele | 62/50.2 |
| 2,972,960 | 2/1961 | Philip | 62/50.6 |
| 4,242,878 | 1/1981 | Brinkerhoff | 62/119 |
| 4,296,610 | 10/1981 | Davis | 62/50.1 |
| 4,432,209 | 2/1984 | Landry et al. | 62/62 |
| 4,582,731 | 4/1986 | Smith | 427/421 |
| 4,734,227 | 3/1988 | Smith | 264/13 |
| 4,734,451 | 3/1988 | Smith | 524/493 |
| 4,923,720 | 5/1990 | Lee et al. | 427/422 |
| 5,009,367 | 4/1991 | Nielsen | 239/3 |
| 5,027,742 | 7/1991 | Lee et al. | 118/300 |

FOREIGN PATENT DOCUMENTS

| | | | |
|---|---|---|---|
| 2450280 | 4/1976 | Fed. Rep. of Germany | 62/50.1 |

*Primary Examiner*—Albert J. Makay
*Assistant Examiner*—William C. Doerrler
*Attorney, Agent, or Firm*—J. F. Leightner

[57] ABSTRACT

Methods and apparatus for economically and effectively using a portion of a liquified compressed gas feedstock, such as liquid carbon dioxide, as a refrigerant to cool said liquified compressed gas feedstock so as to prevent cavitation and liquid compressibility when pumping such feedstock are disclosed.

56 Claims, 4 Drawing Sheets

USE OF LIQUIFIED COMPRESSED GASES AS A REFRIGERANT TO SUPPRESS CAVITATION AND COMPRESSIBILITY WHEN PUMPING LIQUIFIED COMPRESSED GASES

RELATED PATENT APPLICATIONS

This application contains subject matter related to U.S. Pat. No. 4,923,720, issued May 8, 1990, and subject matter related to U.S. patent application Ser. No. 413,517, filed Sep. 27, 1989.

FIELD OF THE INVENTION

This invention relates generally to the pumping of liquified compressed gases. More particularly, it relates to the prevention of cavitation and liquid compressibility when pumping liquid carbon dioxide.

BACKGROUND OF THE INVENTION

In the inventions described in the aforementioned related patent applications, an environmentally safe, non-polluting diluent that can be used to thin very highly viscous polymer and coating compositions to liquid spray application consistency is discussed. The diluent utilized, as discussed in these aforementioned related applications, is a supercritical fluid, such as supercritical carbon dioxide and nitrous oxide.

U.S. Pat. No. 4,923,720 discloses processes and apparatus for the liquid spray application of coatings to a substrate that minimize the use of environmentally undesirable organic diluents. The broadest process embodiment of that application involves forming a liquid mixture in a closed system, said liquid mixture comprising at least one polymeric compound capable of forming a coating on a substrate and at least one supercritical fluid in at least an amount which when added to the liquid mixture is sufficient to render the viscosity of the mixture to a point suitable for spray application; and spraying said liquid mixture onto a substrate to form a liquid coating thereon. The application is also directed to a liquid spray process in which the preferred supercritical fluid is carbon dioxide. The process employs an apparatus, which among other things, has the means for supplying supercritical carbon dioxide fluid.

U.S. application Ser. No. 413,517 is directed to methods and apparatus for effectively proportionating a mixture of compressible and non-compressible fluids and, in particular, to the formation of a coating composition mixture containing a substantially accurate proportionated amount of at least one supercritical fluid used as a viscosity reduction diluent.

Because of its relevancy to the present invention, a brief discussion of supercritical fluid phenomena is believed to be warranted.

Supercritical fluid phenomena is well documented, see pages F-62 - F-64 of the CRC Handbook of Chemistry and Physics, 67th Edition, 1986–1987, published by the CRC Press, Inc., Boca Raton, Fla. At high pressures above the critical point, the resulting supercritical fluid, or "dense gas" will attain densities approaching those of a liquid and will assume some of the properties of a liquid. These properties are dependent upon the fluid composition, temperature, and pressure. As used herein, the "critical point" is the transition point at which the liquid and gaseous states of a substance merge into each other and represents the combination of the critical temperature and critical pressure for a given substance. The "critical temperature", as used herein, is defined as the temperature above which a gas cannot be liquified by an increase in pressure. The "critical pressure", as used herein, is defined as that pressure which is just sufficient to cause the appearance of two phases at the critical temperature.

The compressibility of supercritical fluids is great just above the critical temperature where small changes in pressure result in large changes in the specific volume of the supercritical fluid. The "liquid-like" behavior of a supercritical fluid at higher pressures results in greatly enhanced solubilizing capabilities with higher diffusion coefficients and an extended useful temperature range compared to liquids. Compounds of high molecular weight can often be dissolved in the supercritical fluid at relatively low temperatures.

Near-supercritical liquids also demonstrate solubility characteristics and other pertinent properties, such as high compressibility, similar to those of supercritical fluids. These variations are considered to be within the concept of a supercritical fluid as used in the context of this invention. Therefore, as used herein, the phrase "supercritical fluid" denotes a compound above, at, or slightly below the critical temperature and critical pressure (the critical point) of that compound.

In essentially every process in which a mixture is prepared for a particular purpose, the constituents of that mixture usually need to be present in particular, proportionated amounts in order for the mixture to be effective for its intended use. In the aforementioned related patent, the underlying objective is to reduce the amount of organic solvent present in a coating formulation by use of supercritical fluid. Therefore, it is particularly preferred that there be prescribed, proportionated amounts of supercritical fluid and of coating formulation present in the liquid coating mixture to be sprayed.

Accordingly, in order to spray liquid coating formulations containing supercritical fluid as a diluent on a continuous, semi-continuous, and/or an intermittent or periodic on-demand basis, it is necessary to prepare such liquid coating formulations in response to such spraying by accurately mixing a proportioned amount of the coating formulation with the supercritical fluid. However, the compressibility of supercritical fluids is much greater than that of liquids. Consequently, a small change in pressure results in large changes in the specific volume of the supercritical fluid. Liquids also become highly compressible as the temperature and pressure approach critical conditions and therefore liquid properties and gas properties approach each other. As an example, FIG. 1 shows the specific volume-pressure relationship for liquid carbon dioxide (Quinn, E. L. and Jones, C. J., *Carbon Dioxide,* Reinhold, 1936). It can be seen that near or around the critical region, denoted as B in the figure, the specific volume-pressure isotherms become more steeply sloped. The compressibility is the slope of the isotherm, that is, the change in specific volume that occurs with change in pressure at constant temperature. The curve denoted as C, which runs from A to B, is the liquid-vapor equilibrium curve. The liquid compressibility at a pressure of about 1100 psi is given below for several temperatures.

−30° C. 0.2 percent/100-psi
0° C. 0.5 percent/100-psi
10° C. 0.9 percent/100-psi
20° C. 1.8 percent/100-psi
25° C. 3.3 percent/100-psi
30° C. >13.5 percent/100-psi The overall percentage change in liquid volume that occurs when liquid carbon dioxide is pressurized at constant temperature from its vapor pressure (curve C) to a pressure of 1400 psi, which is a typical pressure at which coating materials are sprayed with supercritical carbon dioxide, are given below for several temperatures.

−30° C. 1.5 percent
−20° C. 2.5 percent
−10° C. 3.6 percent
0° C. 4.9 percent
10° C. 6.6 percent
20° C. 9.0 percent
25° C. 13.0 percent
30° C. 23.0 percent This shows that the compressibility increases by about an order-of-magnitude as the temperature increases from refrigerated temperatures to room temperature, which is typically close to the critical temperature of 31° C. Even at the lower pressures, the specific volume change with pressure (liquid compressibility) is significant enough to make the pumping of accurate volumes, per the volumetric displacement in a piston pump, for example, difficult.

The compressibility of the supercritical fluids causes the flow of these materials, through a conduit and/or pump, to oscillate or fluctuate. As a result, when mixed with the coating formulation, the proportion of supercritical fluid in the resulting admixed coating formulation also correspondingly oscillates or fluctuates instead of being uniform and constant. Moreover, the compressibility of liquid carbon dioxide at ambient temperature is high enough to cause flow oscillations and fluctuations to occur when using reciprocating pumps to pump and proportion the carbon dioxide with the coating formulation to form the admixed coating formulation. This particularly occurs when the volume of liquid carbon dioxide in the flow path between the pump and the mixing point with the coating formulation is too large. The oscillation can be promoted or accentuated by any pressure variation that occurs during the reciprocating pump cycle.

In an embodiment discussed in the aforementioned related patent, an apparatus is disclosed for pumping and proportionating a non-compressible fluid with compressible carbon dioxide fluid in order to prepare the ultimate mixture to be sprayed with the carbon dioxide in its supercritical state. In that embodiment, volumetric proportionating of the coating formulation stream and the liquid carbon dioxide stream is carried out by means of reciprocating pumps, which displace a volume of fluid from the pump during each one of its pumping cycles. One reciprocating pump is used to pump the coating formulation and it is slaved to another reciprocating pump that is used to pump the liquid carbon dioxide. The piston rods for each pump are attached to opposite ends of a shaft that pivots up and down on a center fulcrum. The volume ratio is varied by sliding one pump along the shaft, which changes the stroke length.

However, as aforementioned, even when stored at ambient temperature, liquid carbon dioxide is relatively compressible. Such compressibility may undesirably cause fluctuation in the amount of carbon dioxide that is present in the admixed coating formulation that is to be sprayed. This occurs due to the incompatible pumping characteristics of the relatively non compressible coating formulation and the relatively compressible liquid carbon dioxide. With the coating formulation, pressure is immediately generated in the reciprocating pump as soon as its volume is displaced. Inasmuch as the liquid carbon dioxide is substantially compressible, a larger volume is needed to be displaced in order to generate the same pressure. Because mixing occurs when the flow of the coating formulation and of the liquid carbon dioxide are at the same pressure, the flow rate of carbon dioxide lags behind the flow rate of the coating formulation.

This oscillation is accentuated if the driving force operating the pump varies during the operating cycle, such as an air motor changing direction during its cycle. Thus, if the driving force declines, the pressure in the coating formulation flow declines even more rapidly, due to its non-compressibility, than the pressure in the liquid carbon dioxide flow, due to its being compressible.

Accordingly, the pressures generated in both flows may be out of phase during the pumping cycle, such that the proportion of carbon dioxide in the mixture to be sprayed also varies. This oscillation is made even more severe if cavitation also occurs in the carbon dioxide pump due to vapor formation as the pump fills.

Resolution of inaccuracy in the proportionation ascribed to fluctuation in the flow of the compressible fluid is discussed in the aforementioned related U.S. patent application Ser. No. 413,517, wherein methods and apparatus are disclosed for accurately and continuously providing a proportionated mixture comprised of a non-compressible fluid and a compressible fluid for spraying onto a substrate to be coated. In particular, mass proportionation is relied upon to obtain the desired mixture of the compressible and non-compressible fluids. Specifically, the mass flow rate of the compressible fluid is continuously and instantaneously measured. Regardless of what that flow rate is and whether or not it is oscillating as a result of, for example, being pumped by a reciprocating pump or regardless of the state in which such compressible fluid is in, that mass flow rate information is fed to a signal processor in a continuous and instantaneous manner. Based on that received information, the signal processor, in response to the mass of compressible fluid that has been measured, controls a metering device which controls the rate of flow of the non-compressible fluid. The non-compressible fluid is then metered in a precise, predetermined proportion relative to the mass flow rate of the compressible fluid such that, when the compressible and non-compressible fluids are subsequently mixed, they are present in the admixed coating formulation in the proper proportions.

By measuring the mass flow rate of the substantially compressible fluid, and then controlling the amount of non-compressible fluid in response thereto, the measuring fluctuation problem associated with the compressibility of the compressible fluid is substantially eliminated. Any fluctuations or oscillations present in the flow of the compressible fluid are instantaneously measured and are compensated by controlling the amount of non-compressible fluid to provide the prescribed proportionation for the desired mixture. In contrast to past techniques, the embodiment in the said patent application involves the metering, i.e., controlling the flow rate, of only one fluid, namely, the non-compressible fluid. The flow rate of the compressible fluid is not controlled, but rather, only measured, from which measurement the prescribed amount of non-compressible fluid is correspondingly adjusted to provide the desired proportionation. This allows for total flexibility of the system and provides for a simple and effective means for producing the desired proportionated mixture of compressible and non-compressible fluids.

While the measuring aspect of the fluctuation problem for obtaining a proper mass ratio of an admixture of compressible and non-compressible fluids, such as admixture of coating formulation and carbon dioxide, has essentially been solved by the foregoing invention using mass proportionation, it has not been solved where such mass proportionation is not utilized and cavitation occurs in pumps and other apparatus supplying the compressible fluid such as liquid carbon dioxide.

Cavitation is a phenomenon that can cause severe equipment damage. In pumps, for example, in addition to the potential of causing damage to the pump itself, the efficiency of such pumping also may suffer severely. Without wishing to be bound by theory, cavitation is the formation and collapse of vapor cavities in a flowing liquid. In a flowing liquid, if at any time the pressure reduces to that of the vapor pressure of the liquid at the temperature of such flowing liquid, the liquid boils and small bubbles, or cavities, of vapor form in large numbers. These bubbles are present in the flow and upon reaching a point where the pressure is higher, they collapse suddenly as vapor condensation occurs, such as in a pump. With condensation, a void is created and the surrounding liquid rapidly fills it, with collision occurring in the center of the void. This results in the creation of very high local pressures, which have been measured at pressures up to 200,000 pounds per square inch. All surfaces in contact with the liquid are subject to the consequences of this phenomenon, due to the energy being transmitted by these pressure waves. The equipment can be damaged, or fail, by fatigue and/or erosion, which is aided by corrosion with the surface becoming badly scored and pitted. Mechanical breakdown of equipment components can also occur due to metal removal, for example. Cavitation may also be attended by considerable vibration and noise.

Another significant problem associated with cavitation in a pump is its effect on the pump's capacity. Cavitation creates much more heat from the mechanical work of compression, which then starts a feedback cycle that may cause the pump to become inoperative. Thus, cavitation results in the generation of heat in the pump. This makes the contents of the pump more compressible which results in the further heating of the compressible fluid being pumped at the inlet to the pump. This, in turn, results in escalating the cavitation, which in turn results in yet further heating and even greater cavitation. Accordingly, to keep the pump operationally stable, it is extremely desirable that cavitation be controlled by some technique that limits the internal heating caused by the work of compression.

Protection against cavitation damage may take several forms such as, for example, the use of highly resistant materials where cavitation is expected, which may include special coatings, welded overlays, and sprayed materials; cathodic protection; and hydrodynamic design.

With respect to cavitation-inhibiting and corrosion-inhibiting compounds, U.S. Pat. No. 4,404,113, issued Sep. 13, 1983, discusses the use of many suitable compounds such as glycols, alkali metal tetraborates, mercaptans, sulfated ethers, alkali metal silicates, aliphatic higher alcohols , cellulose ethers, polyvinylpyrrolidone, polyhydric alcohols selected from the group comprising glycerol alkylene glycols having 2 to 6 carbon atoms, and oxyalkylene glycols of oxyethylene and/or oxypropylene, having a total of 4 to 12 carbon atoms, as the main constituent. However, the presence of such compounds in materials to be pumped may not always be tolerable. For example, in the aforementioned related patent, such components would cause contamination of the coating admixture which would lead to, among other things, imperfections in the coating sprayed onto the substrate.

Protection against cavitation by hydrodynamic design includes, but is not limited to, consideration of proper size of conduits and fittings to minimize pressure loss due to frictional effects during the flow of the liquid, especially when using a high viscosity fluid; the mechanical design of pumps to minimize the potential of internal pressure changes that are conducive to cavitation; the location of the liquid source and the pump suction line; and maintaining the required "net positive suction pressure", which is defined as the absolute pressure above the vapor pressure of the liquid at the pump inlet that is required to prevent the phenomena caused by cavitation. Therefore, control of operating temperature, thereby controlling the vapor pressure of the liquid, and controlling the pump's upstream and downstream pressures, without affecting the desired pressure increase, are effective in the essential relief of cavitation.

In the pumping of cryogenic liquids and/or liquified compressed gases, reciprocating-type pumps are most often employed, although rotary vane pumps are also used for pumping cryogenic liquids. With reciprocating-type pumps, one area of concern in pumping is the problem associated with heat management. Heat conduction from the warm end of the pump to the pumping chamber portion of the pump body, heat leakage from the ambient environment, frictional heat generated by the reciprocating motion of the plunger, and heat generation in the pumping chamber due to fluid compression are recognized as major sources of pump inefficiency. As discussed by Pevzner in U.S. Pat. No. 4,576,557, the principal approach for overcoming such problems has been to intercept the heat conducted from the warm end of the pump by means of heat exchange with a cold fluid. Thus, pumps utilizing suction liquid, blowby fluid, and pressurized liquid have been proposed in the art. For example, Picard, U.S. Pat. No. 1,895,295, describes the submersion of the pump in a cryogenic liquid and the use of heat transfer fins on the pump body to improve heat transfer between the pumping chamber and the pumped liquid. Similarly, Hughes, U.S. Pat. No. 2,931,313, and Lady, U.S. Pat. No. 2,973,629, provide an annular cooling jacket surrounding the pumping chamber, with cryogenic liquid being passed through said cooling jacket prior to being introduced into the pumping chamber on the suction stroke of the pump. In Riede, U.S. Pat. No. 2,730,957, Gottzmann, U.S. Pat. No. 3,136,136, and Schuck, U.S. Pat. No. 4,156,584, blowby fluid is passed in a direction opposite to the heat flux so as to intercept the heat conducted from the warm end of the pump. These approaches can effectively prevent major problems, such as vapor binding, which would normally accompany an inordinate heat flux to the cold end of the pump. One deficiency associated with these methods is the inability to precisely control the amount of cooling being accomplished. In many instances, therefore, the warm end of the pump may actually become too cold for proper performance.

Therefore, auxiliary heating means may actually have to be employed in many instances. Such auxiliary heating means represents an additional and otherwise unnecessary heat load in the pump.

In addition to such efforts to prevent the conduction of heat from the warm to the cold end of cryogenic pumps, structural means are also employed in both the Riede and the Schuck patents. For example, a thin tubular section is employed to connect the cold pumping chamber to the warm packing end of the pump. Such means, however, contribute to other mechanical design problems. Pevzner, in U.S. Pat. No. 4,576,557, disclosed a unitary pump body support structure having forward and rearward pump body mounting plates and a power frame mounting plate that is precisely aligned with, and secured to, the power frame of the pump. The valve assembly, pump body, packing assembly and pump body cooling jacket can advantageously be mounted on the unitary support structure.

Other approaches taken in the pumping of a liquified compressed gas is its sub-cooling; or the use of another pump, a fore-pump, to provide an initial increase of pressure; or a refrigerant of lower temperature than the liquified gas to be pumped is applied to prevent vapor binding and, more importantly, cavitation. An example using similar means is disclosed in Japanese Patent No. 57-67773, issued Apr. 24, 1982, which describes a method to prevent cavitation of the intake liquid of a pump which receives the re-liquified gas during the delivery of a low temperature liquified gas for conversion into electricity, wherein a regenerator, a gasifier, and an expansion turbine are installed downstream from a delivery pump, and upon pressurizing, a low temperature liquified gas is delivered by the delivery pump to the downstream user. A portion of this expanded gas is routed through the above mentioned regenerator and is recondensed. This condensed liquid is then fed into a receiving reservoir and the condensed liquid in the receiving reservoir is delivered to the above mentioned gasifier by means of a condensed liquid pump. In some instances, a portion of the discharged liquid from the delivery pump, whose temperature is lower than the condensed liquid fed the receiving reservoir, is fed into the bottom of the receiving reservoir. Accordingly, the intake liquid of the condensed liquid pump is in a supercooled state in relationship to the liquid near the surface of the receiving reservoir. When such supercooled liquid is drawn in by the condensed liquid pump, the vapor pressure of the intake liquid continues to be minimal, and it is extremely unlikely that bubbling and spontaneous boiling phenomena will occur. Such a means is not applicable in the apparatus and methods of the aforementioned related patent applications, wherein the downstream use is for a liquid, in which case expanded gas for routing to the regenerator would not be available.

For large-scale industrial applications, the supply of liquid carbon dioxide is usually provided from a bulk storage system that includes a low-pressure liquid carbon dioxide tank, which is capable of delivering saturated liquid carbon dioxide to points of application under accurate temperature control. These systems are well known to those skilled in the art and they normally consist of a pumping system at the tank with insulated liquid piping in which carbon dioxide circulates past the point of application and then back to the storage tank; integral to the storage tank is a mechanical refrigeration unit. In these industrial applications when sub-cooling is desired, a mechanical refrigeration unit and heat exchanger are used to cool the liquid carbon dioxide before it reaches the point of application. In this manner, sub-cooled liquid carbon dioxide circulates continuously whether carbon dioxide is or is not being used. When the mechanical refrigeration unit and heat exchanger are located in the loop beyond the point of application, the returning liquid carbon dioxide can be cooled, resulting in a reduced refrigeration load on the bulk storage vessel. When sub cooling is incorporated in such a system specifically for prevention of cavitation, capital and operating costs constitute a deterrent to its use in many instances. Indeed, the use of liquid carbon dioxide as a refrigerant is well known. However, in the present instance, using carbon dioxide in a typical refrigeration cycle is not economically viable.

The use of consumable liquid carbon dioxide in free expansion is well known, for example, in fire extinguishers, low-temperature testing of aviation, missile, and electronic components, for pre- and post-chilling trucks, containers, railroad cars, etc., for rubber tumbling, and for controlling chemical reactions. In vacuum-insulated vessels, such as railroad cars, for example, liquid carbon dioxide is injected directly into the car wherein it expands into a mixture of solid and vapor, with temperatures from about −20° F. to 50° F. available from manual setting of a thermostat. Another example typical of such means is disclosed in U.S. Pat. Nos. 4,086,783 and 4,086,784, both issued May 2, 1978, which consists of an apparatus for refrigerating articles, in which a valve is utilized for selectively introducing a cryogen that is a liquid above the triple point pressure but converts to a solid and then a gas at the triple point conditions. For carbon dioxide the satisfactory operating conditions of the liquid supply was found to be about 300 psig at 0° F. When the temperature in the refrigeration chamber called for more liquid carbon dioxide the valve opened and projected a conical spray of carbon dioxide which was a mixture of snow particles and gas onto deflector plates where the carbon dioxide fanned out across and longitudinally into the chamber. Complete uniform circulation of refrigerant and complete evaporation of the carbon dioxide snow was assured by fans.

FIG. 2 shows the equilibrium phase diagram for carbon dioxide (Quinn, E. L. and Jones, C. J., *Carbon Dioxide,* Reinhold, 1936). The figure shows the phases that carbon dioxide has at different combinations of temperature and pressure. The carbon dioxide exists as just one phase in the open spaces and the solid lines indicate where two phases exist simultaneously in equilibrium. The three equilibrium lines meet at the triple point, denoted by TP in the figure, which is the only condition at which three phases exist simultaneously in equilibrium. The triple point temperature is about −57° C. (−71° F.) and the triple point pressure is about 75 psia (60 psig). The equilibrium line between the liquid and vapor (gas) phases ends at the critical point, denoted by CP in the figure, where the properties of the liquid and vapor phases become identical. The carbon dioxide becomes supercritical above the critical point.

Several methods of carbon dioxide cooling are discussed in "Low-Temperature Processing in Pilot Plants" by R. L. Braun, *Chemical Engineering* (Jan. 16, 1978), pages 129–134. One of these methods passes liquid carbon dioxide through an expansion device wherein adiabatic direct expansion and vaporization produces a vapor-solid mixture that flows directly into the jacket of a chemical reactor. The liquid carbon dioxide is stored at 300 psig at 0° F. and is expanded to snow and vapor at atmospheric pressure at −109° F. Referring to FIG. 2, it can be clearly seen that when saturated liquid carbon dioxide at 300 psi and 0° F. is adiabatically expanded to atmospheric pressure, the expansion follows the equilibrium curve with the existence of two phases with quality that changes from saturated liquid (at zero quality) to about 50:50 liquid and vapor carbon dioxide (quality of 0.5) as the expansion proceeds, as found when referring to a temperature-entropy diagram for carbon dioxide (not shown), until the triple point is reached wherein the two phases now become a solid and vapor phase of about the same quality. When the pressure reaches atmospheric, the temperature is now about −109° F., assuming adiabatic conditions, and the carbon dioxide exhausts to the atmosphere as a vapor, with some residual crystals, or particles, of solid carbon dioxide. Problems inherent in using this type of carbon dioxide cooling means, include: plugging of the reactor jacket with solid carbon dioxide; uneven heat transfer, including localized cold spots; and poor temperature control, all of which elicit the reasons why such means are inadequate for utilization in the aforementioned inventions for the spray application of coating material diluted with supercritical carbon dioxide to achieve the state of properties essential for allowing effective spray coating onto a substrate.

It is accordingly seen that the utilization of such means for the prevention of cavitation and the suppression of undesirable phenomena associated with liquid compressibility when pumping a compressible fluid, such as carbon dioxide, are inadequate, inefficient, and costly if used with the spray coating apparatus disclosed in the aforementioned related patent and patent applications. What is needed is a low cost, direct-expansion refrigeration means, which avoids the complexities of indirect refrigeration, while avoiding the problems associated with direct adiabatic expansion of the liquid refrigerant into a vapor-solid mixture. Such a means has been found and forms the basis of the present invention.

SUMMARY OF THE INVENTION

By virtue of the present invention, methods and apparatus have been discovered which are able to accomplish these objectives. The invention in its broadest aspect comprises a means of supplying a portion of a liquified compressed gas feedstock, such as carbon dioxide or nitrous oxide, as a refrigerant means to a heat exchange means provided to the liquid carbon dioxide or nitrous oxide feedstock supply means to cool, or at least prevent warming of said feedstock, thereby suppressing and/or preventing cavitation and liquid compressibility when pumping said feedstock.

In particular, the present invention is directed to a method for helping to prevent cavitation and liquid compressibility when pumping at least one liquified compressed gas which is a gas at standard temperature and pressure conditions (STP) of 1 atmosphere and 0° C. comprising:

a) supplying a first at least one liquified compressed gas which is to be pumped, said liquified compressed gas being a gas at STP conditions; and b) sufficiently cooling the first at least one liquified compressed gas so as to substantially prevent cavitation and liquid compressibility of such first liquified compressed gas by the adiabatic direct expansion of a second at least one liquified compressed gas which is a gas at STP conditions and which is in indirect heat exchange relationship with the first at least one liquified compressed gas, said adiabatic direct expansion being such that the temperature and pressure of the second at least one liquified compressed gas are not below its triple point.

In a more preferred embodiment, the present invention is directed to a method for helping to prevent cavitation and liquid compressibility when pumping at least one liquified compressed gas which is a gas at standard temperature and pressure conditions (STP) of 1 atmosphere and 0° C. comprising:

a) supplying the at least one liquified compressed gas which is to be pumped, said liquified compressed gas being a gas at STP conditions; and b) sufficiently cooling the at least one liquified compressed gas so as to substantially prevent cavitation and liquid compressibility of such liquified compressed gas by allowing a portion of such liquified compressed gas to undergo adiabatic direct expansion while it is in indirect heat exchange relationship with the remaining liquified compressed gas, said adiabatic direct expansion being such that the temperature and pressure of the at least one liquified compressed gas are not below its triple point.

In a further embodiment, the present invention is directed to a method for helping to prevent cavitation and liquid compressibility when pumping at least one liquified compressed gas which is a gas at standard temperature and pressure conditions (STP) of 1 atmosphere and 0° C. comprising:

a) supplying a first at least one liquified compressed gas which is to be pumped, said liquified compressed gas being a gas at STP conditions;

b) cooling the first at least one liquified compressed gas by the adiabatic direct expansion of a second at least one liquified compressed gas which is a gas at STP conditions and which is in indirect heat exchange relationship with the first at least one liquified compressed gas;

c) measuring the temperature of the cooled first at least one liquified compressed gas and generating at least one signal in response to such measurement;

d) supplying the second at least one liquified compressed gas as the refrigerant for cooling step (b) in response to the at least one signal generated in step (c) such that the first at least one liquified compressed gas is sufficiently cooled to help prevent cavitation and liquid compressibility and the temperature and pressure of the second at least one liquified compressed gas is maintained above its triple point during the adiabatic direct expansion thereof; and e) pumping the cooled first at least one liquified compressed gas.

In a still further embodiment, the present invention is directed to a method for helping to prevent cavitation and liquid compressibility when pumping at least one liquified compressed gas which is a gas at standard temperature and pressure conditions (STP) of 1 atmosphere and 0° C. comprising:

a) supplying a first at least one liquified compressed gas which is to be pumped, said liquified compressed gas being a gas at STP conditions;

b) cooling the first at least one liquified compressed gas by the adiabatic direct expansion of a second at least one liquified compressed gas which is a gas at STP conditions and which is in indirect heat exchange relationship with the first at least one liquified compressed gas;

c) pumping the cooled first at least one liquified compressed gas at a pumping flow rate;

d) measuring the pumping flow rate of the first at least one liquified compressed gas and generating at least one signal in response to such measurement;

e) supplying the second at least one liquified compressed gas as the refrigerant for cooling step (b) in response to the at least one signal generated in step (d) such that the first at least one liquified compressed gas is sufficiently cooled to help prevent cavitation and liquid compressibility and the temperature and pressure of the second at least one liquified compressed gas is maintained above its triple point during the adiabatic direct expansion thereof; and f) pumping the sufficiently cooled first at least one liquified compressed gas.

In yet a further embodiment, the present invention is directed to a method for helping to prevent cavitation and liquid compressibility when pumping at least one liquified compressed gas which is a gas at standard temperature and pressure conditions (STP) of 1 atmosphere and 0° C. comprising:

a) supplying a first at least one liquified compressed gas which is to be pumped, said liquified compressed gas being a gas at STP conditions;

b) cooling the first at least one liquified compressed gas by the adiabatic direct expansion of a second at least one liquified compressed gas which is a gas at STP conditions and which is in indirect heat exchange relationship with the first at least one liquified compressed gas;

c) pumping the cooled first at least one liquified compressed gas to at least one spray gun that sprays the at least one liquified compressed gas;

d) spraying the first at least one liquified compressed gas and generating at least one signal in response to such spraying;

e) supplying the second at least one liquified compressed gas as the refrigerant for cooling step (b) in response to the at least one signal generated in step (d) such that the first at least one liquified compressed gas is sufficiently cooled to help prevent cavitation and liquid compressibility and the temperature and pressure of the second at least one liquified compressed gas is maintained above its triple point during the adiabatic direct expansion thereof.

More specifically, the present invention comprises, in a more preferred embodiment, a refrigeration means of cooling in heat exchange apparatus the liquified compressed gas feedstock, such as carbon dioxide, between the feedstock supply cylinder and a liquified compressed gas primer (booster) pump, with further cooling of the liquified compressed gas flowing in the feed line communicating with the primer pump means and also cooling the primer pump head means. Said cooling means further comprises attaining said cooling (refrigeration) by the controlled adiabatic direct-expansion of the liquified compressed gas, such as carbon dioxide, into the refrigerant passages of the heat exchange apparatus.

The present invention is also directed to apparatus, particularly, an apparatus for helping to prevent cavitation and liquid compressibility when pumping liquified compressed gases comprising:

a) means for supplying a first at least one liquified compressed gas which is to be pumped, said liquified compressed gas being a gas at standard temperature and pressure conditions (STP) of 1 atmosphere and 0° C.;

b) means for sufficiently cooling the first at least one liquified compressed gas so as to substantially prevent cavitation and liquid compressibility of such first liquified compressed gas by the adiabatic direct expansion of a second at least one liquid compressed gas which is a gas at STP conditions and which is in indirect heat exchange relationship with the first at least one liquified compressed gas;

c) means for controlling the adiabatic direct expansion of the second at least one liquified compressed gas such that its temperature and pressure are maintained above its triple point; and d) means for pumping the cooled first at least one liquified compressed gas.

In a more preferred embodiment, the present invention is directed to an apparatus for helping to prevent cavitation and liquid compressibility when pumping liquified compressed gases comprising:

a) means for supplying a first at least one liquified compressed gas which is a gas at standard temperature and pressure conditions (STP) of 1 atmosphere and 0° C.;

b) means for supplying a second at least one liquified compressed gas which is a gas at STP conditions;

c) heat exchange means for cooling the first at least one liquified compressed gas by the adiabatic direct expansion of the second at least one liquified compressed gas which is in indirect heat exchange relationship with the first at least one liquified compressed gas;

d) means for pumping the first at least one liquified compressed gas cooled in step (c);

e) means for generating at least one signal indicative of the further cooling required of the cooled first at least one liquified compressed gas so as to substantially prevent cavitation and liquid compressibility of such cooled first liquified compressed gas;

f) means for regulating the supply of the second at least one liquified compressed gas as the refrigerant for cooling step (c) in response to the at least one signal generated in step (e) such that the first at least one liquified compressed gas is sufficiently cooled to help prevent cavitation and liquid compressibility and to maintain the temperature and pressure of the second at least one liquified compressed gas above its triple point during the adiabatic direct expansion thereof.

The invention is also directed to a cooling means wherein a primer pump is not utilized in the feedstock supply system. In which case, the invention comprises a means of cooling, by the controlled adiabatic direct-expansion of liquified compressed gas in heat exchange apparatus, the liquified compressed gas feedstock flowing between the feedstock supply and the liquified compressed gas pump within the spray coating apparatus, which said pump is utilized to supply said feedstock to the spray coating apparatus, or other apparatus.

The foregoing and other objectives, advantages and features of the invention will become apparent upon a consideration of the following detailed description.

DETAILED DESCRIPTION OF THE INVENTION

It has been found that by using the method and apparatus of the present invention, liquified compressed gases, such as carbon dioxide and nitrous oxide, and the like, can be supplied to a spray coating apparatus using supercritical liquified compressed gases such as carbon dioxide and nitrous oxide as a diluent to reduce or replace organic diluents in the spray application of a coating material onto the substrate, said supply and proportionation being inexpensively effected with the prevention of cavitation and liquid compressibility in the apparatus by means of supplying accurately proportionated carbon dioxide, for example, by sub-cooling the liquid carbon dioxide through the essentially adiabatic direct-expansion of liquid carbon dioxide in one, or more than one, heat exchanger. Moreover, said method is also useful in the pumping and proportioning of cryogenic liquids, such as nitrogen and liquified natural gas. As used herein, "direct-expansion" is defined as the flashing (vaporization) of refrigerant directly into the refrigerant side of the heat exchange apparatus, as distinguished from using a brine, which is any liquid that has been indirectly cooled by a refrigerant in a separate evaporator and circulated as a heat transfer fluid.

The liquified compressed gas that is utilized is cooled sufficiently below its supply tank or cylinder temperature such that its vapor pressure is reduced adequately below the pressure at the supply pump inlet, including frictional line losses and other expansion and contraction losses, such that cavitation does not occur when using the pump for volumetric proportionation to accurately proportion the liquified compressed gas with another material also being supplied to a downstream end-use apparatus, or allowing cavitation to be kept sufficiently low and controlled to allow said pump to operate reasonably efficiently, without major mechanical damage, when pumping the liquified compressed gas with proportionation being accomplished by other means in the end use apparatus; in the latter case, the pump functions only as a booster pump or as the feedstock supply pump.

While the following discussion will primarily be directed to liquid carbon dioxide, it is to be understood that the present invention and the discussion that follows is applicable to any liquified compressed gas which is a gas at standard temperature and pressure conditions of 0° C. and 1 atmosphere.

Figure 1:
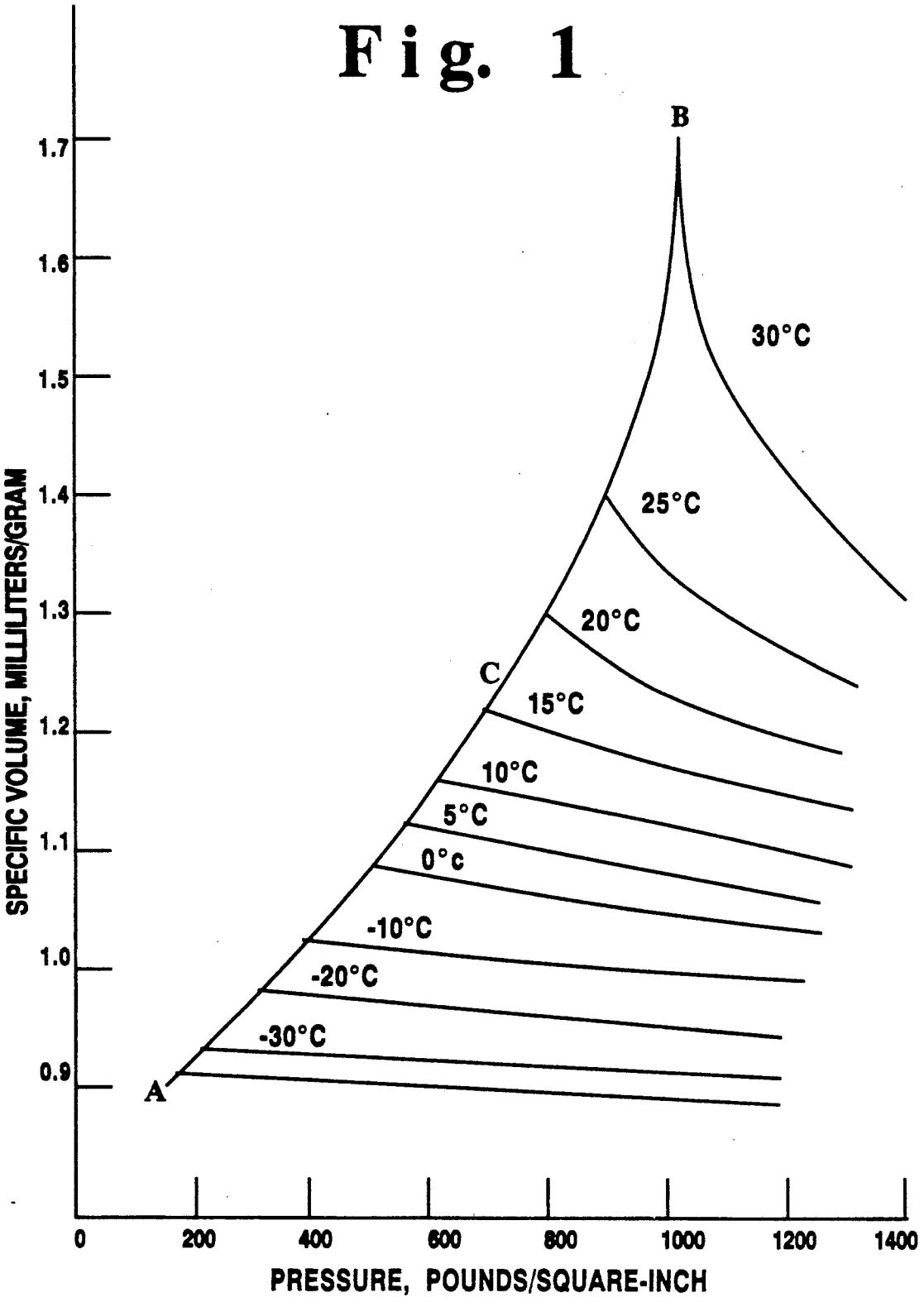
FIG. 1 is a graph illustrating the specific volume versus pressure relationship of liquid carbon dioxide.
Figure 2:
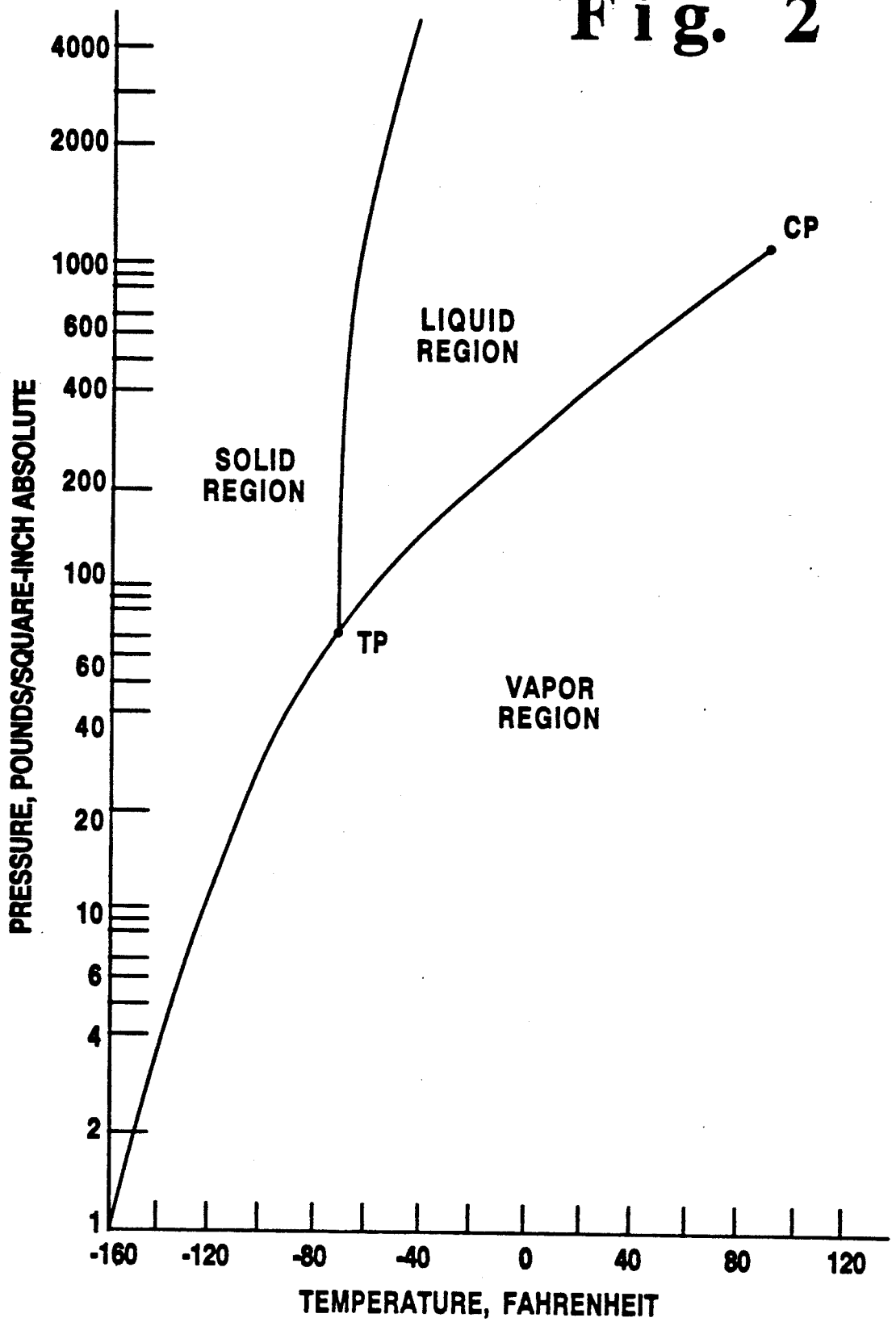
FIG. 2 is a graph illustrating the pressure versus temperature phase relationship of carbon dioxide.
Figure 3:
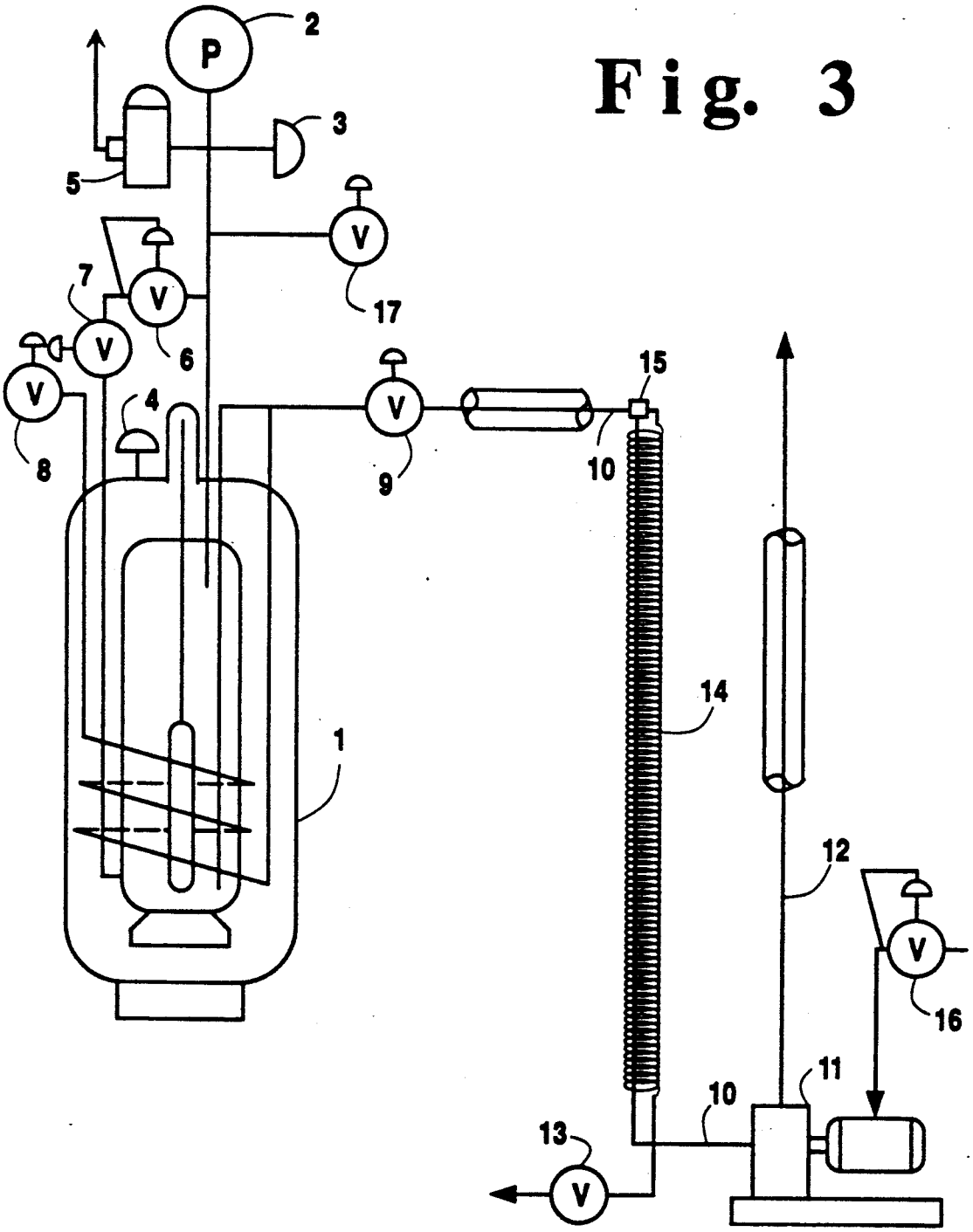
FIG. 3 is a schematic diagram of one embodiment of the present invention showing the basic elements of the carbon dioxide supply used in supplying cooled carbon dioxide.

Referring to FIG. 3, which shows a schematic diagram of the present invention in its most basic form, liquid carbon dioxide is supplied from a refrigerated liquid carbon dioxide cylinder, (1), such as an Airco refrigerated liquid cylinder, that contains liquid carbon dioxide at a pressure of about 300 psig and a temperature maintained at about 0° F., which is introduced into insulated line (10). From line (10), the carbon dioxide is pumped by primary pumping means (11), such as a Haskel Inc., model AG-15 single acting air driven pump, through insulated line (12) to a downstream application (not shown). As it applies to the above noted related patent applications, in the downstream application the carbon dioxide would be mixed with coating formulation to form a sprayable coating admixture. Pressure regulator (16) regulates the air pressure of the compressed air fed to the air motor of pump (11). The feed line (10) from the carbon dioxide supply (1) to the pump (11), the discharge line (12) from pump (11) to the downstream application, and the pump are preferably insulated with commercially available refrigeration-service-grade insulation known to those skilled in the art.

Feed line (10) is cooled by passing a side stream bleed flow of carbon dioxide through an external cooling coil (14) that extends along the length of line (10), such as by wrapping 1/16-inch outside-diameter capillary tubing around and fitting to the contour of line (10) and insulating the assembly as aforementioned. Liquid carbon dioxide is supplied to coil (14) by connecting it to tee fitting (15) in line (10). A portion of the liquid carbon dioxide vaporizes as it passes through the capillary tube before being discharged to the atmosphere through discharge valve (13). If desired, a suitable variable or fixed flow constriction (not shown), such as a valve or an orifice plate, such as used in orifice flow meters, may be inserted into line (14) downstream of tee (15) to increase or regulate the degree of pressure drop and hence expansion, vaporization, and cooling that occurs as the liquid carbon dioxide enters cooling coil (14). Additional such constrictions may be staged along the length of cooling coil (14) to provide staged incremental pressure reductions.

The commercially available refrigerated liquid carbon dioxide cylinder (1) is supplied with devices for overpressurization protection, venting, and the like, which include: pressure gauge (2); burst discs (3) and (4); safety valve (5); pressure regulator (6) and shut off valve (7); gas use valve (8); liquid use valve (9); and gas vent valve (17).

In the broad embodiment of the present invention, pumping means (11) is not narrowly critical to the present invention. It may comprise any kind of a pump that is capable of pumping a compressible fluid and it may be driven by any conventional means, for instance, air drive or electrical drive means. A conventional reciprocating pump, for example, which is well known to those skilled in the art is quite suitable. In the present invention, it has been found that the reciprocating pump is preferably designed for a high feed pressure, and should preferably not cause a significant change in outlet pressure during a pumping cycle. Normally, liquid carbon dioxide is stored either refrigerated at a pressure of 300 psig and a temperature of about 0° F. or at a pressure of about 830 psia at room temperature. Some double-acting pump designs are designed for low feed pressures; consequently, a high feed pressure may affect the forces in the pump and alter the outlet pressure during the pumping cycle. A typical double-acting three-check-valve pump should preferably not be used for pumping liquid carbon dioxide. A double-acting piston pump having four check valves that can accommodate a high feed pressure is particularly suitable in the present invention for pumping the liquid carbon dioxide.

In operation, line (10), pump (11), and line (12) are filled and primed with liquid carbon dioxide by opening valve (9) at the supply cylinder and by opening a suitable bleed valve (not shown) located at the downstream application. Valve (13) is then cracked open to allow liquid carbon dioxide at a low rate to flow through tee (15), through cooling coil (14), and through valve (13) into the environment. The nearly adiabatic expansion provides cooling of the feed stock (process) carbon dioxide that flows through line (10) to pump (11). The flow rate of carbon dioxide through coil (14) is adjusted manually to provide sufficient cooling to substantially prevent cavitation and liquid compressibility of the feedstock carbon dioxide flowing to pump (11) and to maintain the carbon dioxide passing through cooling coil (14) above the triple point condition so that solid carbon dioxide does not form and plug the cooling coil. A pressure gauge and/or thermocouple (not shown) may be inserted into cooling line (14) before outlet valve (13) to monitor the pressure and/or temperature of the carbon dioxide exiting from the cooling coil.

Figure 4:
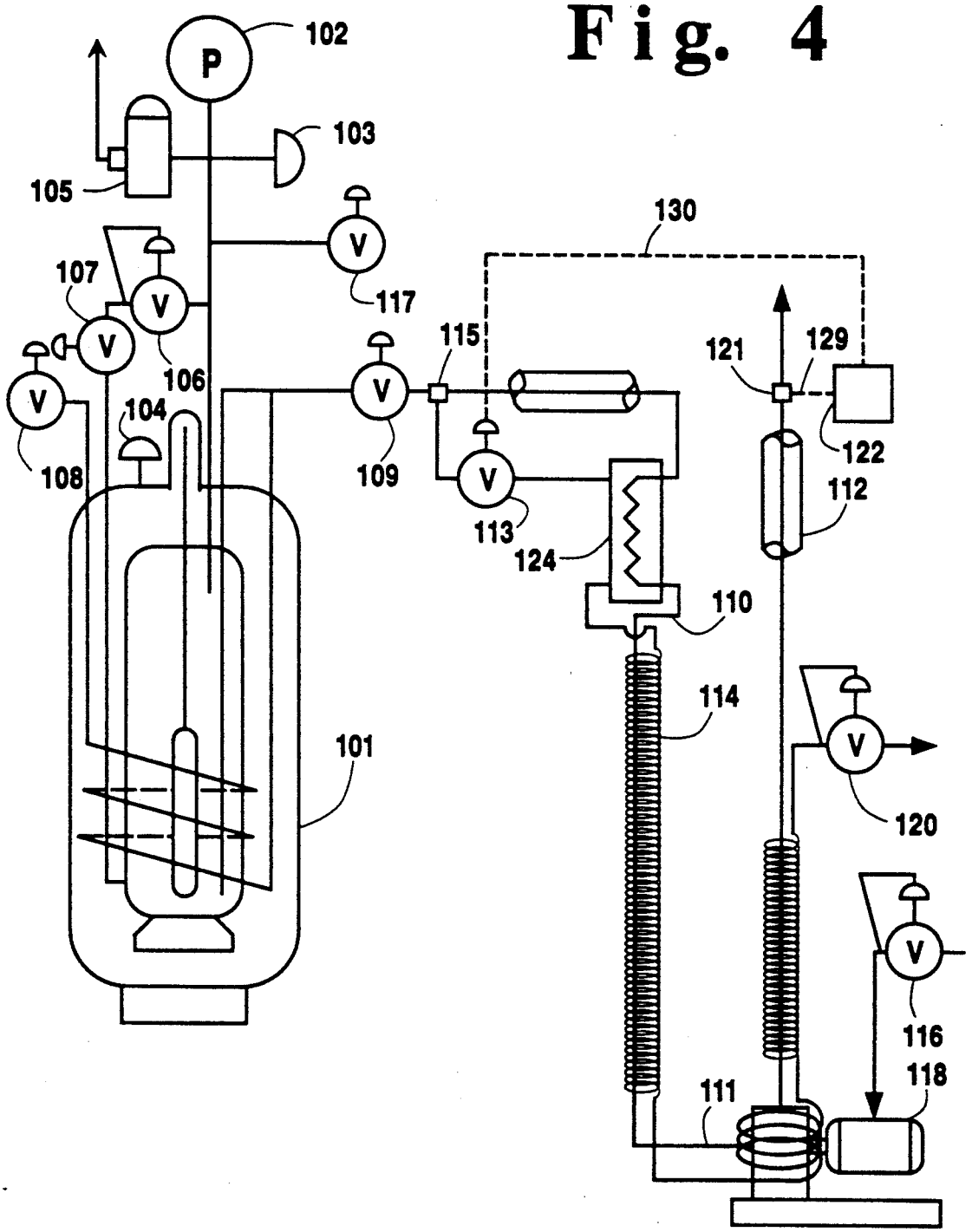
FIG. 4 is a schematic diagram of a more preferred embodiment of the apparatus shown in FIG. 3.

In a more preferred embodiment, which is shown in FIG. 4, the liquid carbon dioxide is subcooled and a lower temperature is maintained up to the point of introduction into the downstream apparatus by utilizing an optional heat exchange means, external cooling coil means around the feed lines between the carbon dioxide supply and the downstream apparatus, pump head cooling means, and process control means. Referring to FIG. 4, liquid carbon dioxide is supplied upon demand from a refrigerated liquid carbon dioxide supply system shown generally as (101), such as commercially available from Minnesota Valley Engineering, DURAMAX 500, which holds about 400 pounds of liquid carbon dioxide at about 200 to 350 psig normal operating pressure with liquid delivery rates of up to 1000 pounds per hour at 350 psig. The carbon dioxide supply system apparatus (101) includes: pressure gauge (102); burst discs (103) and (104) and safety valve (105) to protect against overpressurization; gas pressure regulator (106); service valve (107); gas supply valve (108); liquid supply valve (109); and cylinder filling gas vent valve (117). The refrigerated liquid carbon dioxide, typically supplied at a pressure of about 300 psig, is fed to an air driven carbon dioxide primer pump (111), such as Haskel Inc., model 8AGD-14, for initial pressurization, with pumping energy supplied by compressed air to the pump air motor, which is regulated by pressure regulator (116). Feed line (110) between supply source (101) and primer pump (111) is provided with an optional heat exchange cooling means (124), such as any suitable commercially available cold-service type heat exchanger, which are well known to those skilled in the art. Feed line (110) is also cooled by wrapping a coil (114) of suitable tubing externally along and around the line fitting its contour. Moreover, feed line (112), which connects pump (111) to the downstream application (not shown) that utilizes the carbon dioxide, is preferably likewise wrapped with tubing to provide external cooling coil (119). The cooling tubings (114) and (119) may also be thermally contacted with lines (110) and (112), respectively, by other means than wrapping the tubing around the line, such as running the tubing and line together side-by-side, if desired. More than one cooling line may also be used in parallel. Instead of wrapping the lines externally with tubing, commercially available concentric double-pipe or double-tubing heat exchangers may be utilized. Further, the pumping head of pump (111) is also preferably externally wrapped with a coil of tubing (118), which is fitted to the contour of the pump head. When employing certain types of reciprocating pumps, such as those available from manufacturers such as Milton Roy, Inc., wrapping a cooling coil around the pump is unnecessary because the manufacturer supplies pumps with heat exchange jacketed pump heads. In the present embodiment, heat exchanger (124) and external cooling coils (114), (118), and (119) are shown connected in series. A portion of the liquid carbon dioxide supplied from source (101) flows: through tee (115) in feed line (110) to a cooling flow control means (113), such as a controlled variable orifice expansion valve; through the shell side of heat exchanger (124); through cooling coil (114) along line (110); through cooling coil (118) around pump (111); through cooling coil (119) along line (112); and finally through pressure regulator (120) for discharge into the atmosphere or optionally into a storage vessel (not shown) for subsequent use as a supply of lower pressure carbon dioxide. The cooled feed line and pump assemblies are preferably insulated with suitable commercially available refrigeration-service-grade insulation means.

Process control of the cooling may be accomplished by any of several means known to those skilled in the art. The means and apparatus selected in the present instance, as shown in FIG. 4, comprise commercially obtainable apparatus and consist of a control means (122), such as a programmable microprocessor recorder; a flow control means (113), such as a controlled variable orifice expansion valve, and a pressure control means, such as a back pressure regulator (120), both located in the cooling circuit; and a temperature sensing thermocouple (121) located in process feed line (112). The control means (122) is set or programmed to control the temperature of the liquid carbon dioxide being supplied to the downstream application through feed line (112), such that cavitation and compressibility are suppressed and/or prevented both in primer pump (111) and in the downstream apparatus pump (not shown), which provides the pressurization to increase the carbon dioxide pressure to above its critical pressure. The control point temperature could also be located at other desirable locations, such as at the inlet to pump (111) to control the inlet temperature. Control means (122) receives a temperature signal (129) from thermocouple (121) and generates a signal (130) which indicates the relative degree of cooling required to obtain the set point temperature at thermocouple (121) and adjusts flow control means (113) to provide the proper carbon dioxide flow required for proper cooling. Back pressure regulator (120) is set to maintain the cooling carbon dioxide pressure above the triple point pressure of about 75 psia (60 psig). It is important that the expanding cooling carbon dioxide fluid does not reach the triple point so that solid carbon dioxide does not form, which would plug the equipment. This would stop the flow of the coolant, which would prevent cooling of the process liquid carbon dioxide and result in the undesirable consequences associated with cavitation and compressibility that could now occur in the liquid carbon dioxide pumps.

Cooling of the liquid carbon dioxide is accomplished by the nearly adiabatic direct-expansion of liquid carbon dioxide refrigerant, supplied through tee (115) in line (110) to: valve (113), heat exchanger (124), external cooling coil (114), and pump-head cooling coil (118); wherein vaporization with ensuing heat exchange across the physical boundaries between the two fluids within the apparatus supply cooled liquid carbon dioxide into the inlet of pump (111), such that cavitation and compressibility are suppressed and/or prevented as the fluid is increased in pressure by pump (111) to within the range of about 1000 to about 1500 psig. Pump (111) is driven by an air motor supplied with compressed air regulated to about 70 psig by regulator (116), the exact air pressure depending upon the desired outlet pressure.

Under some conditions, the temperature of the process liquid carbon dioxide exiting primer pump (111) may reach as high as 80° F., depending upon the degree of inlet cooling, because of the transfer of thermal energy developed by the mechanical operation of the pump into the process stream. The process carbon dioxide feed stream at this point is at a pressure sufficiently above its vapor pressure of about 955 psig, at 80° F., such that pressure drop within the downstream application pump would be insufficient to reduce the pressure below the vapor pressure and thereby allow cavitation to occur. Although cavitation of the carbon dioxide is not expected to be a problem downstream of the apparatus shown in FIG. 4, supplementary cooling in external cooling coil (119) provides additional protection to prevent cavitation and compressibility in the downstream application pump used in accordance with the aforementioned related patent applications, wherein it is pressurized to a pressure of about 1600 to about 2300 psig.

To prevent the formation and presence of solid carbon dioxide in the refrigeration apparatus in accordance with the present invention, back pressure regulator (120) is set to maintain and control the carbon dioxide refrigerant system pressure above the triple point pressure of the carbon dioxide, namely, above about 60 psig. From regulator (120), the carbon dioxide exhausts to the atmosphere or to a storage vessel from which it may be further used in the process, for example, alone as a compressed gas and/or in an admixture with compressed air to supply the energy to operate the pump (111) air motor.

It is to be understood that process control methods and apparatus known to those skilled in the art, other than that shown in FIG. 4, may be utilized to effect the desired control of the refrigeration of the liquid carbon dioxide process feed stream by the nearly adiabatic direct expansion of liquid carbon dioxide into the refrigerant side of the heat exchange means. Regardless of how it is effected, the temperature and pressure of the liquified compressed gas used as a refrigerant must be controlled such that it never drops below its triple point value. By doing so, formation of the solid phase is avoided thereby preventing the plugging problems associated with such solid formation as discussed earlier.

Another control method that may be utilized is to measure the pumping rate or flow rate of the process liquified compressed gas, instead of measuring its temperature, and to generate a signal which indicates the relative degree of cooling required and which controls the cooling flow control means. Generally, the degree of cooling required will be proportional to the process gas flow rate, in addition to the cooling required due to heating from the environment. Therefore, when the flow rate increases, more cooling is required, and when the flow rate decreases, less cooling is required. With no flow rate, a low steady level of cooling is required to compensate for heating from the environment. Therefore, the flow rate signal can be used to control the cooling flow control means (113), such as the position of a variable orifice control valve.

The aforementioned related patent application discloses a method and apparatus for providing a proportionated mixture comprised of, for example, a non-compressible coating material and compressible liquified compressed gas for spraying onto a substrate to be coated. This is done by measuring the mass flow rate of the liquified compressed gas, such as by a mass flow meter, and then controlling the amount of coating formulation in response thereto. Therefore, a preferred method of measuring the pumping rate or flow rate of the feedstock or process liquified compressed gas is to utilize the mass flow meter of the downstream application apparatus which is used to proportion the process liquified compressed gas with coating material for spray application. It is furthermore preferred to utilize the signal thereby generated in response to the measurement, which controls the flow rate of the coating material in the downstream application, to also control the cooling flow control means of the present invention.

Another control method that may be used is to generate a signal which indicates the relative degree of cooling required of the process liquified compressed gas by activation of at least one spray gun that sprays the process liquified compressed gas with coating material. Generally, the degree of cooling required will be proportional to the rate at which the admixture of coating material and supercritical fluid derived from the process liquified compressed gas is sprayed from a spray gun. More than one spray gun increases the degree of cooling required proportionately. Generally, spraying is done at fixed conditions so that the spray rate remains uniform over time. Therefore, the degree of cooling required is directly related to the number of spray guns spraying at any given time. Therefore, a signal may be generated by any suitable means, such as the signal that turns automatic spray guns on and off, to indicate the number of spray guns that are activated at any given time, and such signal will indicate the relative degree of cooling required and can be used to control the cooling flow control means of the present invention. When manual spray guns are utilized, a simple electronic or pneumatic switch may be incorporated into the spray gun trigger to generate a signal that the spray gun is spraying.

In another embodiment of the method and apparatus shown in FIG. 4, the heat exchanger and the several external cooling coils shown may be operated in parallel. In such an embodiment (not shown), instead of each apparatus receiving its supply of refrigerant from the preceding apparatus, as shown in FIG. 4, each apparatus receives a distinct and separate supply of the liquid carbon dioxide refrigerant, wherein it is expanded through a device provided in each refrigerant feed line to each respective piece of equipment and then exhausted to the atmosphere, for example, through a back pressure regulator provided in the fluid line exiting each separate piece of equipment. Separate control methods and apparatus would also be provided for each individual component to control and maintain the process liquid carbon dioxide at the desired set point.

Any suitable cooling flow control means (113) in addition to a controlled variable orifice expansion valve may also be used. For example, simpler methods and apparatus may be used for applications in which only two cooling flow control rates are required, which correspond to flow and no flow of the process liquified compressed gas, because the flow is constant when flow occurs. In this situation, the control valve may be replaced by two valves in parallel. The first valve is sized or opened to supply the cooling flow rate required to compensate for heating from the environment and the second valve is a simple on/off valve that is sized to supply the required cooling flow rate when the process liquified compressed gas is flowing at its normal rate. Likewise three or more valves in parallel may be used when three or more flow rates occur. For example, for a spray process with two sets of one or more spray guns, three cooling flow rates may be required, corresponding to either none, one, or both sets of spray guns spraying. A signal may be generated from each set of spray guns to indicate when the set of spray guns is activated and spraying and therefore the relative degree of cooling that is required. Each signal then controls a separate on/off valve located in parallel in the cooling flow line (110). Alternatively, the signals generated by activation of the sets of spray guns may reposition the orifice opening of a control valve that has three fixed settings that correspond to the required cooling levels.

The objective of the present invention to significantly subcool, or prevent the warming of liquified compressed gases, such as carbon dioxide, which are to be pumped as part of an overall process so as to prevent cavitation and liquid compressibility in such supply pump(s) is most preferably and economically attained through the controlled adiabatic direct expansion of a portion of the liquified compressed gas which acts as a refrigerant to the remainder of the liquified compress gases by means of a suitable heat exchange apparatus. The amount of liquid carbon dioxide, for example, used for refrigeration is proportional to the pumping rate and degree of subcooling, assuming adiabatic conditions with respect to the surroundings, and is a small proportion of the total amount of the liquified carbon dioxide being supplied and pumped. An energy balance shows the cooling specific heat requirement is much less than the latent heat of vaporization (of the portion of the compressed gas being expanded) required to sustain said cooling. An estimate for the nominal operation of the method and apparatus using carbon dioxide, for example, predicts the amount required for refrigeration to be generally less than about 5 percent and at more extreme conditions would not be expected to exceed about 10 to 20 percent. Because liquified carbon dioxide and compressed gases are, in general, relatively inexpensive, the economic penalty of expending same in practicing the methods of this invention is slight compared to the expense associated with using electrical energy for refrigeration or the cost of the feedstock (process) liquified compressed gas consumed in the downstream application.

Although the foregoing embodiments of the present invention disclose the use of refrigerated liquid carbon dioxide as the source of the process fluid with the same acting as the refrigerant, it is also beneficial to utilize ambient liquid carbon dioxide. That is, for example, instead of supplying the liquid carbon dioxide fluid from a refrigerated cylinder at about 0° F. and about 300 psig, liquid carbon dioxide can be supplied to the process from a compressed gas cylinder at room temperature with the vapor pressure generally being about 850 psig; the actual pressure being a function of the actual room temperature, consequently there will be minor variation in said pressure as the room temperature changes. Accordingly, the same apparatus and general method as previously presented may still be utilized with only minor changes, if any, in the set points of the apparatus controlling the method and apparatus. However, a penalty is associated with using excessively high temperature liquified carbon dioxide, that is, close to the critical temperature of about 87° F. (31° C.), because the latent heat of vaporization decreases with increasing temperature; it is about halved when comparing the carbon dioxide in the supply cylinder at 70° F. to 0° F. and becomes zero at the critical temperature. Such penalty thereby requires the expenditure of about twice as much liquified compressed gas as the refrigerant when using the higher temperature supply. At the critical point, the latent heat of vaporization does not contribute to the cooling effect of the direct expansion, so more carbon dioxide must be used and the process becomes inefficient. As with the foregoing method, the triple point conditions must not be reached during the adiabatic expansion of the liquid carbon dioxide such that the vapor-solid two phase equilibrium region is not ingressed.

Liquid carbon dioxide is often transported in refrigerated tank trucks at a pressure of about 200 psig and a temperature of about −32° C. (−25° F.) and then is pumped into refrigerated bulk storage tanks that are at a pressure of about 300 psig and a temperature of about −18° C. (0° F.). The process of the present invention may be utilized at said refrigerated tank truck conditions, but preferably not at lower pressures or temperatures because such conditions more closely approach the triple point.

Therefore, the process of the present invention preferably uses liquid carbon dioxide that is supplied at a pressure in the range of from about 200 psig to about 1000 psig and at a temperature in the range of from about −32° C. to about 27° C. More preferably, the liquid carbon dioxide is supplied at a pressure in the range of from about 250 psig to about 900 psig and at a temperature in the range of from about −25° C. to about 24° C. Most preferably, the liquid carbon dioxide is supplied at typical bulk storage refrigerated conditions having a temperature of about −18° C. and a pressure of about 300 psig.

Still further, although all of the foregoing embodiments disclose the use of a portion of the liquified compressed gas which is being pumped as the refrigerant media, it is to be understood that this is not required, but rather merely preferred. The refrigerant media clearly does not have to have as its source the material which is being pumped. Such refrigerant may be an entirely independent source of liquified compressed gas which is a gas at STP and indeed, need not even be the same material as that which is being pumped. The refrigerant may comprise one or a number of liquified compressed gases which may or may not be the same as the material which is being pumped. For some spray coating applications of the aforementioned related patent applications, supercritical fluids other than carbon dioxide, or a mixture of carbon dioxide with other supercritical fluids, may be desirably used to apply the coating. For example, nitrous oxide may be used or a mixture of carbon dioxide with nitrous oxide may be used as a first liquified compressed gas for spraying. For these applications, it is preferred to use a separate supply of carbon dioxide as a second liquified compressed gas to provide cooling of the first liquified compressed gas by adiabatic direct expansion in indirect heat exchange relationship such that it does not drop below its triple point. This is preferred because carbon dioxide is less expensive than nitrous oxide and because carbon dioxide may be exhausted in small amounts directly into a well ventilated work place, such as from the cooling vent, whereas it is desirable for nitrous oxide to be vented only inside a spray booth with high air flow to minimize exposure to workers. Regardless of what liquified gas or mixture of such gases is used as the refrigerant, the temperature and pressure of such refrigerant is always controlled so as to prevent the formation of solid within the refrigeration system.

Moreover, while it is understood that adiabatic direct expansion of the liquified compressed gas may occur by simply passing the liquified gas through a valve thereby achieving a sudden pressure drop, it is most desirable, as has been discussed in the foregoing embodiments, that there be a gradual drop in pressure for such expansion to occur such that a pressure gradient exists from the inlet valve to the exhaust valve. This may be accomplished, for example, the cooling coils shown in FIGS. 3 and 4 which provide sufficient flow resistance to facilitate the formation of such a desired pressure gradient.

While preferred forms of the present invention have been described, it should be apparent to those skilled in the art that methods and apparatus may be employed that are different from those shown without departing from the spirit and scope thereof.

The following examples are provided to further illustrate the invention in nature and are not to be construed as limiting the scope of the invention.

EXAMPLE 1

An apparatus for supplying sub-cooled carbon dioxide to apparatus described in the aforementioned related patent applications was assembled according to the schematic diagram shown in FIG. 3. Carbon dioxide was supplied from an Airco refrigerated liquid cylinder (1) that contained 380 pounds of liquid carbon dioxide at 300 psig and 0° F. Liquid carbon dioxide was withdrawn from the cylinder through an eductor tube through valve (9) and was pressurized by carbon dioxide primer pump (11), which was located at the refrigerated liquid cylinder and used to pressurize the carbon dioxide feed to the downstream carbon dioxide liquid supply pump (not shown) to about 1100 psig, which was above the vapor pressure at rom temperature (about 830 psig). The slow-opening valve (13) located at the end of the thin capillary tubing (14) wrapped externally around the feed tubing (10) between the cryogenic cylinder and the carbon dioxide primer pump was opened slowly to a position that allowed about one-half pound of liquid carbon dioxide per hour to vaporize and bleed off, which kept the feed line cold, particularly when carbon dioxide was not flowing. The bleed carbon dioxide was drawn from the tee-connection (15) in line (10) located at the liquid exit valve (9) of cylinder (1). When using the carbon dioxide primer pump, with cooling of the carbon dioxide feed prior to the inlet of the pump, it was observed that neither the carbon dioxide liquid booster pump nor, more importantly, the carbon dioxide liquid supply pump in the spray coating apparatus, experienced cavitation.

EXAMPLE 2

Comparison Example

The apparatus, operating conditions, and procedure, were the same as in Example 1, except that the feed line from the refrigerated liquid carbon dioxide cylinder to the carbon dioxide primer pump was not insulated nor cooled by the bleed-off of liquified carbon dioxide through the capillary tubing. This mode of operation caused the carbon dioxide primer pump to cavitate substantially, more so such that it had to operate at a much faster speed to deliver the same mass flow rate of carbon dioxide demanded, its total capacity being severely reduced. This caused the primer pump to heat the carbon dioxide because of the resulting greater mechanical work of compression. The temperature of the carbon dioxide at the outlet of the primer pump rose to about 104° F. at a pressure of about 1300 psig.

What is claimed is:

1. A method for helping to prevent cavitation and liquid compressibility when pumping at least one liquified compressed gas which is a gas at standard temperature and pressure conditions (STP) of 1 atmosphere and 0° C. comprising:

a) supplying a first at least one liquified compressed gas which is to be pumped, said liquified compressed gas being a gas at STP conditions; and b) sufficiently cooling the first at least one liquified compressed gas so as to substantially prevent cavitation and liquid compressibility of such first liquified compressed gas by the adiabatic direct expansion of a second at least one liquified compressed gas which is a gas at STP conditions and which is in indirect heat exchange relationship with the first at least one liquified compressed gas, said adiabatic direct expansion being such that the temperature and pressure of the second at least one liquified compressed gas are not below its triple point.

2. The method of claim 1, wherein the second at least one liquified compressed gas is a portion of the first at least one liquified compressed gas.

3. The method of claim 2, wherein the liquified compressed gas is liquid carbon dioxide having a triple point of about −57° C. and about 75 psia.

4. The method of claim 1, wherein the first at least one liquified compressed gas is comprised of liquid nitrous oxide and the second at least one liquified compressed gas is comprised of liquid carbon dioxide.

5. The method of claim 1, wherein the first at least one liquified compressed gas is comprised of a liquid mixture of carbon dioxide and nitrous oxide and the second at least one liquified compressed gas is comprised of liquid carbon dioxide.

6. The method of claim 1, wherein the first at least one liquified compressed gas is comprised of liquid carbon dioxide and is supplied at a pressure in the range of from about 250 to about 900 psig and at a temperature in the range of from about −25° C. to about 24° C.

7. The method of claim 1, wherein the first at least one liquified compressed gas is comprised of liquid carbon dioxide and is supplied at about −18° C. and about 300 psig.

8. The method of claim 1, wherein the second at least one liquified compressed gas is comprised of liquid carbon dioxide and is supplied at a pressure in the range of from about 250 to about 900 psig and at a temperature in the range of from about −25° C. to about 24° C.

9. The method of claim 1, wherein the second at least one liquified compressed gas is comprised of liquid carbon dioxide at a temperature of about −18° C. and a pressure of about 300 psig.

10. A method for helping to prevent cavitation and liquid compressibility when pumping at least one liquified compressed gas which is a gas at standard temperature and pressure conditions (STP) of 1 atmosphere and 0° C. comprising:

a) supplying the at least one liquified compressed gas which is to be pumped, said liquified compressed gas being a gas at STP conditions; and b) sufficiently cooling the at least one liquified compressed gas so as to substantially prevent cavitation and liquid compressibility of such liquified compressed gas by allowing a portion of such liquified compressed gas to undergo adiabatic direct expansion while it is in indirect heat exchange relationship with the remaining liquified compressed gas, said adiabatic direct expansion being such that the temperature and pressure of the at least one liquified compressed gas are not below its triple point.

11. The method of claim 10, wherein the at least one liquified compressed gas is comprised of liquid carbon dioxide.

12. A method for helping to prevent cavitation and liquid compressibility when pumping at least one liquified compressed gas which is a gas at standard temperature and pressure conditions (STP) of 1 atmosphere and 0° C. comprising:

a) supplying a first at least one liquified compressed gas which is to be pumped, said liquified compressed gas being a gas at STP conditions;

b) cooling the first at least one liquified compressed gas by the adiabatic direct expansion of a second at least one liquified compressed gas which is a gas at STP conditions and which is in indirect heat exchange relationship with the first at least one liquified compressed gas;

c) measuring the temperature of the cooled first at least one liquified compressed gas and generating at least one signal in response to such measurement;

d) supplying the second at least one liquified compressed gas as the refrigerant for cooling step (b) in response to the at least one signal generated in step (c) such that the first at least one liquified compressed gas is sufficiently cooled to help prevent cavitation and liquid compressibility and the temperature and pressure of the second at least one liquified compressed gas is maintained above its triple point during the adiabatic direct expansion thereof; and e) pumping the cooled first at least one liquified compressed gas.

13. The method of claim 12, wherein the second at least one liquified compressed gas is a portion of the first at least one liquified compressed gas.

14. The method of claim 13, wherein the liquified compressed gas is liquid carbon dioxide having a triple point of about −57° C. and about 75 psia.

15. The method of claim 12, wherein the first at least one liquified compressed gas is comprised of liquid nitrous oxide and the second at least one liquified compressed gas is comprised of liquid carbon dioxide.

16. The method of claim 12, wherein the first at least one liquified compressed gas is comprised of a liquid mixture of carbon dioxide and nitrous oxide and the second at least one liquified compressed gas is comprised of liquid carbon dioxide.

17. The method of claim 12, wherein the first at least one liquified compressed gas is comprised of liquid carbon dioxide and is supplied at a pressure in the range of from about 250 to about 900 psig and at a temperature in the range of from about −25° C. to about 24° C.

18. The method of claim 12, wherein the first at least one liquified compressed gas is comprised of liquid carbon dioxide and is supplied at about −18° C. and about 300 psig.

19. The method of claim 12, wherein the second at least one liquified compressed gas is comprised of liquid carbon dioxide and is supplied at a pressure in the range of from about 250 to about 900 psig and at a temperature in the range of from about −25° C. to about 24° C.

20. The method of claim 12, wherein the second at least one liquified compressed gas is comprised of liquid carbon dioxide at a temperature at about −18° C. and a pressure of about 300 psig.

21. A method for helping to prevent cavitation and liquid compressibility when pumping at least one liquified compressed gas which is a gas at standard temperature and pressure conditions (STP) of 1 atmosphere and 0° C. comprising:

a) supplying a first at least one liquified compressed gas which is to be pumped, said liquified compressed gas being a gas at STP conditions;

b) cooling the first at least one liquified compressed gas by the adiabatic direct expansion of a second at least one liquified compressed gas which is a gas at STP conditions and which is in indirect heat exchange relationship with the first at least one liquified compressed gas;

c) pumping the cooled first at least one liquified compressed gas at a pumping flow rate;

d) measuring the pumping flow rate of the first at least one liquified compressed gas and generating at least one signal in response to such measurement;

e) supplying the second at least one liquified compressed gas as the refrigerant for cooling step (b) in response to the at least one signal generated in step (d) such that the first at least one liquified compressed gas is sufficiently cooled to help prevent cavitation and liquid compressibility and the temperature and pressure of the second at least one liquified compressed gas is maintained above its triple point during the adiabatic direct expansion thereof; and f) pumping the sufficiently cooled first at least one liquified compressed gas.

22. The method of claim 21, wherein the pumping flow rate of the first at least one liquified compressed gas is measured by using a mass flow meter.

23. The method of claim 21, wherein the second at least one liquified compressed gas is a portion of the first at least one liquified compressed gas.

24. The method of claim 21, wherein the liquified compressed gas is liquid carbon dioxide having a triple point of about −57° C. and about 75 psia.

25. The method of claim 21, wherein the first at least one liquified compressed gas is comprised of liquid nitrous oxide and the second at last one liquified compressed gas is comprised of liquid carbon dioxide.

26. The method of claim 21, wherein the first at least one liquified compressed gas is comprised of a liquid mixture of carbon dioxide and nitrous oxide and the second at least one liquified compressed gas is comprised of liquid carbon dioxide.

27. The method of claim 21, wherein the first at least one liquified compressed gas is comprised of liquid carbon dioxide and is supplied at a pressure in the range of from about 250 to about 900 psig and at a temperature in the range of from about −25° C. to about 24° C.

28. The method of claim 21, wherein the first at least one liquified compressed gas is comprised of liquid carbon dioxide and is supplied at about −18° C. and about 300 psig.

29. The method of claim 21, wherein the second at least one liquified compressed gas is comprised of liquid carbon dioxide and is supplied at a pressure in the range of from about 250 to about 900 psig and at a temperature in the range of from about −25° C. to about 24° C.

30. The method of claim 21, wherein the second at least one liquified compressed gas is comprised of liquid carbon dioxide at a temperature at about −18° C. and a pressure of about 300 psig.

31. A method for helping to prevent cavitation and liquid compressibility when pumping at least one liquified compressed gas which is a gas at standard temperature and pressure conditions (STP) of 1 atmosphere and 0° C. comprising:

a) supplying a first at least one liquified compressed gas which is to be pumped, said liquified compressed gas being a gas at STP conditions;

b) cooling the first at least one liquified compressed gas by the adiabatic direct expansion of a second at least one liquified compressed gas which is a gas at STP conditions and which is in indirect heat exchange relationship with the first at least one liquified compressed gas;

c) pumping the cooled first at least one liquified compressed gas to at least one spray gun that sprays the at least one liquified compressed gas;

d) spraying the first at least one liquified compressed gas and generating at least one signal in response to such spraying;

e) supplying the second at least one liquified compressed gas as the refrigerant for cooling step (b) in response to the at least one signal generated in step (d) such that the first at least one liquified compressed gas is sufficiently cooled to help prevent cavitation and liquid compressibility and the temperature and pressure of the second at least one liquified compressed gas is maintained above its triple point during the adiabatic direct expansion thereof.

32. The method of claim 31, wherein the second at least one liquified compressed gas is a portion of the first at least one liquified compressed gas.

33. The method of claim 31, wherein the liquified compressed gas is liquid carbon dioxide having a triple point of about −57° C. and about 75 psia.

34. The method of claim 31, wherein the first at least one liquified compressed gas is comprised of liquid nitrous oxide and the second at least one liquified compressed gas is comprised of liquid carbon dioxide.

35. The method of claim 31, wherein the first at least one liquified compressed gas is comprised of a liquid mixture of carbon dioxide and nitrous oxide and the second at least one liquified compressed gas is comprised of liquid carbon dioxide.

36. The method of claim 31, wherein the first at least one liquified compressed gas is comprised of liquid carbon dioxide and is supplied at a pressure in the range of from about 250 to about 900 psig and at a temperature in the range of from about −25° C. to about 24° C.

37. The method of claim 31, wherein the first at least one liquified compressed gas is comprised of liquid carbon dioxide and is supplied at about −18° C. and about 300 psig.

38. The method of claim 31, wherein the second at least one liquified compressed gas is comprised of liquid carbon dioxide and is supplied at a pressure in the range of from about 250 to about 900 psig and at a temperature in the range of from about −25° C. to about 24° C.

39. The method of claim 31, wherein the second at least one liquified compressed gas is comprised of liquid carbon dioxide at a temperature at about −18° C. and a pressure of about 300 psig.

40. An apparatus for helping to prevent cavitation and liquid compressibility when pumping liquified compressed gases comprising:

a) means for supplying a first at least one liquified compressed gas which is to be pumped, said liquified compressed gas being a gas at standard temperature and pressure conditions (STP) of 1 atmosphere and 0° C.;

b) means for sufficiently cooling the first at least one liquified compressed gas so as to substantially prevent cavitation and liquid compressibility of such first liquified compressed gas by the adiabatic direct expansion of a second at least one liquid compressed gas which is a gas at STP conditions and which is in indirect heat exchange relationship with the first at least one liquified compressed gas;

c) means for controlling the adiabatic direct expansion of the second at least one liquified compressed gas such that its temperature and pressure are maintained above its triple point; and d) means for pumping the cooled first at least one liquified compressed gas.

41. An apparatus for helping to prevent cavitation and liquid compressibility when pumping liquified compressed gases comprising:

a) means for supplying a first at least one liquified compressed gas which is a gas at standard temperature and pressure conditions (STP) of 1 atmosphere and 0° C.;

b) means for supplying a second at least one liquified compressed gas which is a gas at STP conditions;

c) heat exchange means for cooling the first at least one liquified compressed gas by the adiabatic direct expansion of the second at least one liquified compressed gas which is in indirect heat exchange relationship with the first at least one liquified compressed gas;

d) means for pumping the first at least one liquified compressed gas cooled in step (c);

e) means for generating at least one signal indicative of the further cooling required of the cooled first at least one liquified compressed gas so as to substantially prevent cavitation and liquid compressibility of such cooled first liquified compressed gas;

f) means for regulating the supply of the second at least one liquified compressed gas as the refrigerant for cooling step (c) in response to the at least one signal generated in step (e) such that the first at least one liquified compressed gas is sufficiently cooled to help prevent cavitation and liquid compressibility and to maintain the temperature and pressure of the second at least one liquified compressed gas above its triple point during the adiabatic direct expansion thereof.

42. The apparatus of claim 41, wherein the first at least one liquified compressed gas comprises liquid carbon dioxide and the means for supplying such liquid carbon dioxide comprises a supply vessel.

43. The apparatus of claim 41, wherein the heat exchange means comprises shell-and-tube-type heat exchangers selected from the group consisting of fixed-tube-sheet, U-tube, floating head, divided flow, split flow, bayonet tube, spiral-tube and spiral-plate type heat exchangers.

44. The apparatus of claim 41, wherein the heat exchange means for cooling the first at least one liquified compressed gas comprises an external conduit or tube in thermal contact with the line connecting the supply means of the first liquified compressed gas to the pumping means and through which the second at least one liquified compressed gas flows.

45. The apparatus of claim 41, wherein the heat exchange means for cooling the first at least one liquified compressed gas comprises a double-pipe heat exchanger in line connecting the supply means of the first liquified compressed gas and the pumping means.

46. The apparatus of claim 41, wherein the heat exchange means for cooling the first at least one liquified compressed gas comprises an external coil fitted to the contour of the head of the pumping means.

47. The apparatus of claim 41, wherein the means for pumping the cooled first at least one liquified compressed gas comprises a double-acting, four-check-valve reciprocating pump.

48. The apparatus of claim 41, wherein the means for pumping the cooled first at least one liquified compressed gas comprises an air driven double-acting, four-check-valve reciprocating pump.

49. The apparatus of claim 41, wherein the means for pumping the cooled first at least one liquified compressed gas comprises an air driven, single-acting reciprocating pump having a three-way cycling spool.

50. The apparatus of claim 41, wherein the first and second liquified gases are the same and the means for supplying the first liquified compressed gas is the same as the means for supplying the second liquified compressed gas.

51. The apparatus of claim 41, wherein the first and second liquified gases are the same and the supply means (b) is comprised of a supply line communicating with the supply means (a).

52. The apparatus of claim 41, wherein the means for regulating the supply of the second at least one liquified compressed gas as the refrigerant for cooling step (c) above its triple point comprises a pressure regulator, or a temperature monitor and controller, or a variable orifice control valve, or a combination thereof.

53. The method of claim 41, wherein the means for generating at least one signal which indicates the relative degree of cooling required of the first at least one liquified compressed gas comprises means for measuring the temperature of the cooled first at least one liquified compressed gas and means for generating at least one signal in response to such measurement.

54. The apparatus of claim 41, wherein the means for generating at least one signal which indicates the relative degree of cooling required of the first at least one liquified compressed gas comprises means for measuring the pumping rate or flow rate of the first at least one liquified compressed gas and means for generating at least one signal in response to such measurement.

55. The apparatus of claim 54, wherein the means for measuring the flow rate of the first at least one liquified compressed gas comprises a mass flow meter means used to proportion the first at least one liquified compressed gas with coating material for spray application and means for generating at least one signal in response to such measurement.

56. The apparatus of claim 41, wherein the means for generating at least one signal which indicates the relative degree of cooling required of the first at least one liquified compressed gas comprises means for activating at least one spray gun that sprays the first at least one liquified compressed gas mixed with coating material and means for generating at least one signal in response to such activation.

* * * * *